United States Patent [19]

Giaimo et al.

[11] 4,248,169

[45] Feb. 3, 1981

[54] INTERMITTENTLY OPERABLE NEEDLE THREAD SNUBBER

[75] Inventors: Anthony Giaimo, Staten Island, N.Y.; John R. MacInnes, Union Beach; Robert H. Larsen, Middletown, both of N.J.

[73] Assignee: The Singer Company, Stamford, Conn.

[21] Appl. No.: 128,205

[22] Filed: Mar. 7, 1980

[51] Int. Cl.[3] ..... D05B 47/04

[52] U.S. Cl. ..... 112/255; 226/195; 242/154

[58] Field of Search ..... 112/255, 254, 59, 97; 226/195; 242/154, 153

[56] References Cited

U.S. PATENT DOCUMENTS

| | | | |
|---|---|---|---|
| 331,026 | 11/1885 | Bigelow | 112/255 X |
| 765,239 | 7/1904 | Hadley | 112/255 X |
| 1,041,597 | 10/1912 | Corey | 112/255 |
| 1,312,799 | 8/1919 | Moffatt et al. | 112/255 |
| 1,460,177 | 6/1923 | Ringe et al. | 112/255 |
| 3,496,895 | 2/1970 | Ketterer | 112/255 |

*Primary Examiner*—H. Hampton Hunter

*Attorney, Agent, or Firm*—William V. Ebs; Robert E. Smith; Edward L. Bell

[57] ABSTRACT

A sewing machine thread snubber having a fixed part and having a movable part pivoted thereon is provided with mechanism operable by needle bar reciprocating mechanism for moving the pivoted part of the snubber between a needle thread releasing position and a position wherein a drag is imposed on the thread.

11 Claims, 13 Drawing Figures

Fig. 7.
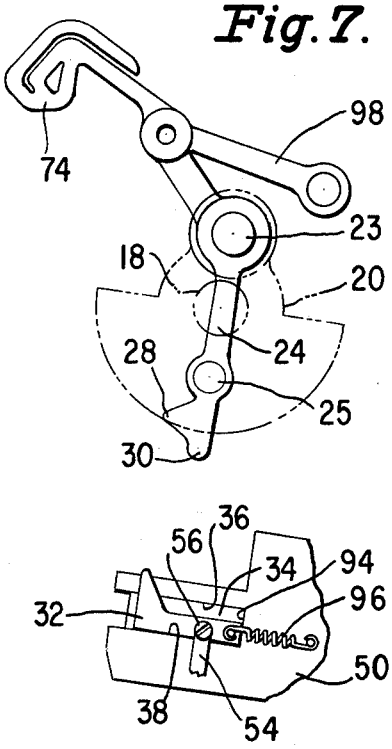
Fig. 8.
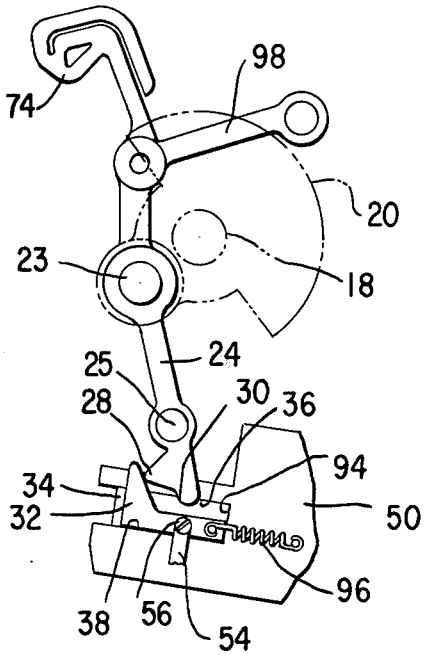
Fig. 9.
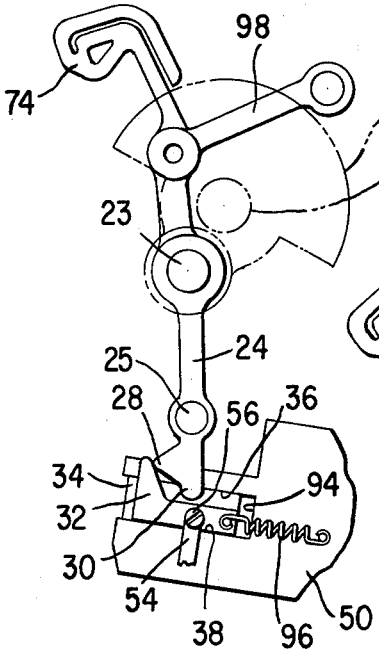
Fig. 10.
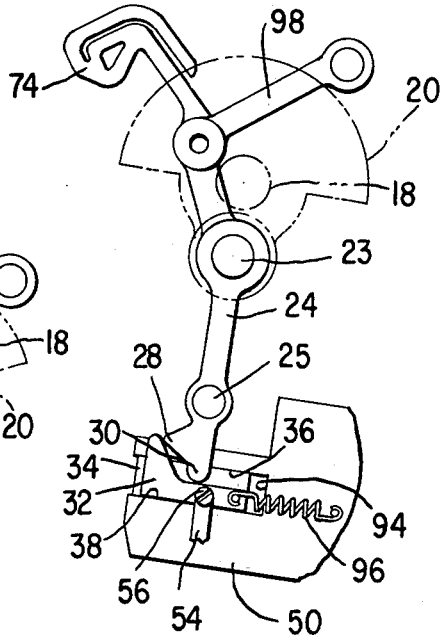
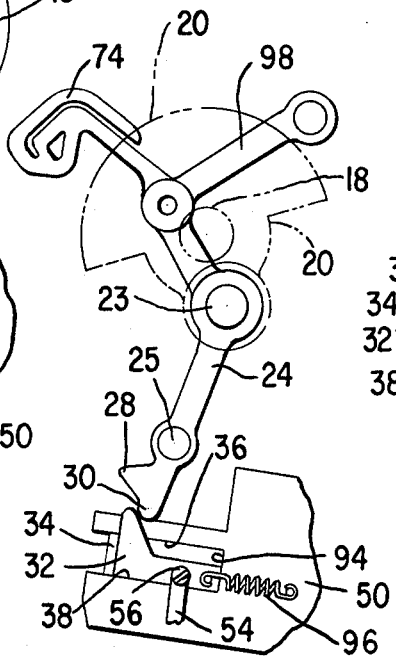
Fig. 11.

INTERMITTENTLY OPERABLE NEEDLE THREAD SNUBBER

DESCRIPTION

BACKGROUND OF THE INVENTION

1. Field of the Invention

The invention is directed to an intermittently operated needle thread snubber for controlling the size of a needle thread loop presented to the loop taker of a lockstitch sewing machine.

2. Description of the Prior Art

It is known to provide a needle thread snubber between a needle and needle thread take-up in a lockstitch sewing machine for limiting the size of the needle thread loop presented to the loop taker. However, commonly used thread snubbers have their drawbacks in that they snub the needle thread not only during loop presentation but also at other stages of stitch formation including stitch setting, and with a thread snubber effective at stitch setting, the needle thread tensioning device must be set at a high value which increases the likelihood of thread breakage. It is therefore desirable to provide for the automatic control of a thread snubber in such fashion that the snubber is caused to apply a drag on needle thread during loop presentation and to remove the drag during stitch setting.

SUMMARY OF THE INVENTION

In accordance with the invention, a lockstitch sewing machine is provided, between a take-up and a sewing needle, with a thread snubber including a thread engageable part which is fixed on the head end portion of the machine and a pivotally mounted thread engageable part which is slidable on the fixed part between a position in which a drag is imposed on thread extending between the parts and a position in which the drag is removed. A spring is provided to bias the pivotally mounted part of the snubber toward one of its alternate positions and mechanism operably connected with the means for reciprocating the take-up and a needle bar is provided to cause the pivotally mounted snubber part to move into and out of the drag imposing position for loop presentation and stitch setting respectively in timed relation to reciprocation of the take-up and needle bar.

DESCRIPTION OF THE DRAWINGS

FIGS. 7, 8, 9, 10 and 11 are somewhat diagrammatic views showing snubber actuating mechanism according to the invention in different positions during operation of the sewing machine.

DESCRIPTION OF THE INVENTION

Figure 2:
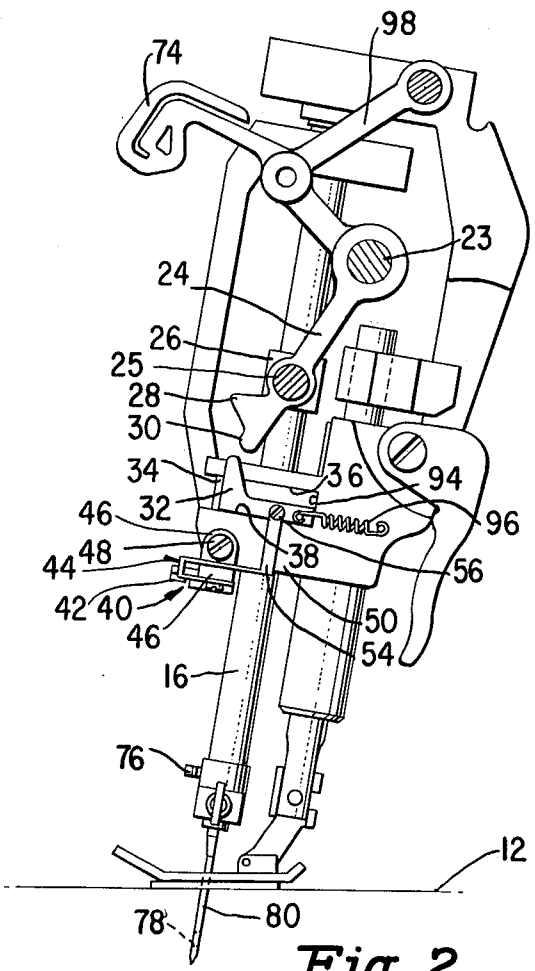
FIG. 2 is a side elevational view of a sewing head frame portion of the sewing machine.
Figure 1:
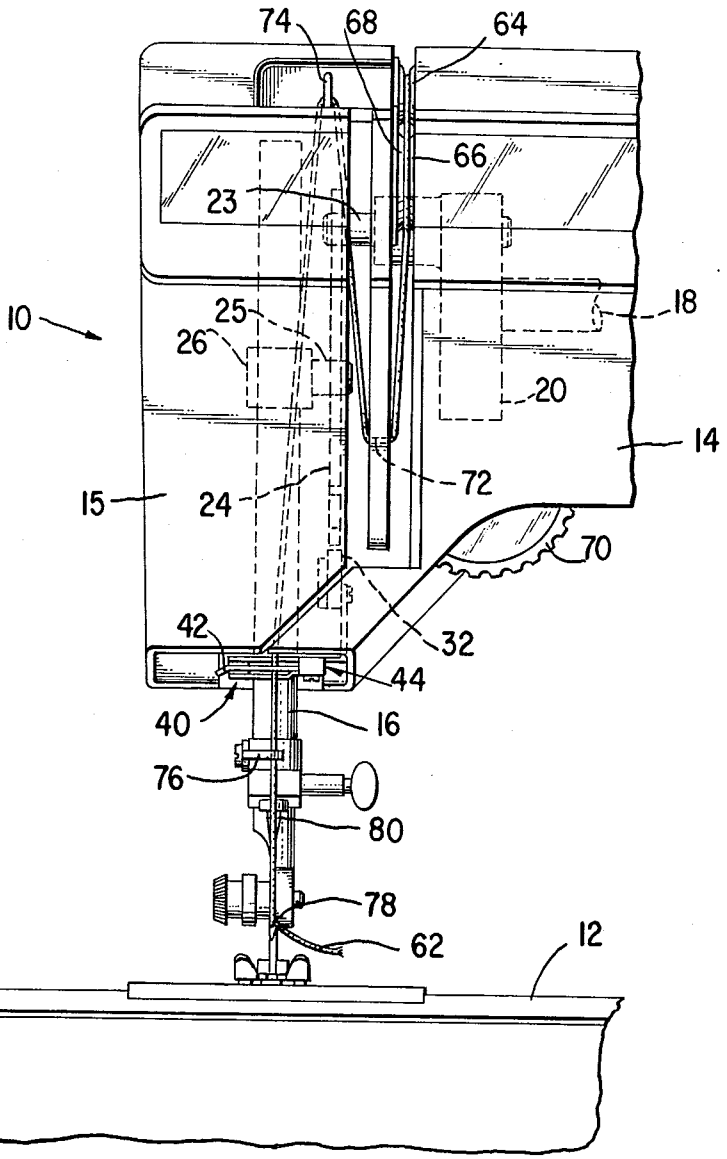
FIG. 1 is a front elevational view of a portion of a sewing machine having a needle thread snubber affixed thereto in accordance with the invention.
Figure 3:
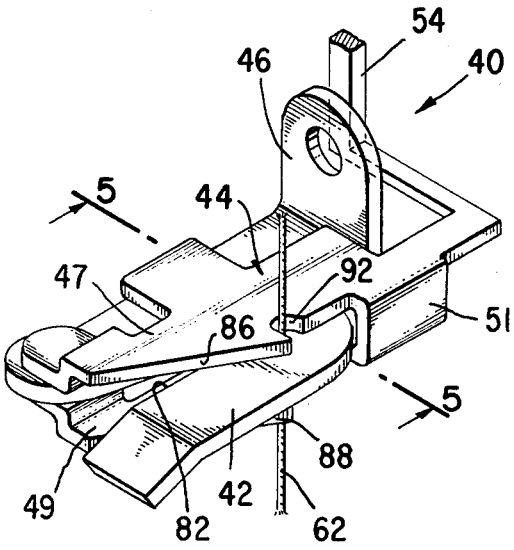
FIG. 3 is an assembled perspective view of the snubber.
Figure 4:
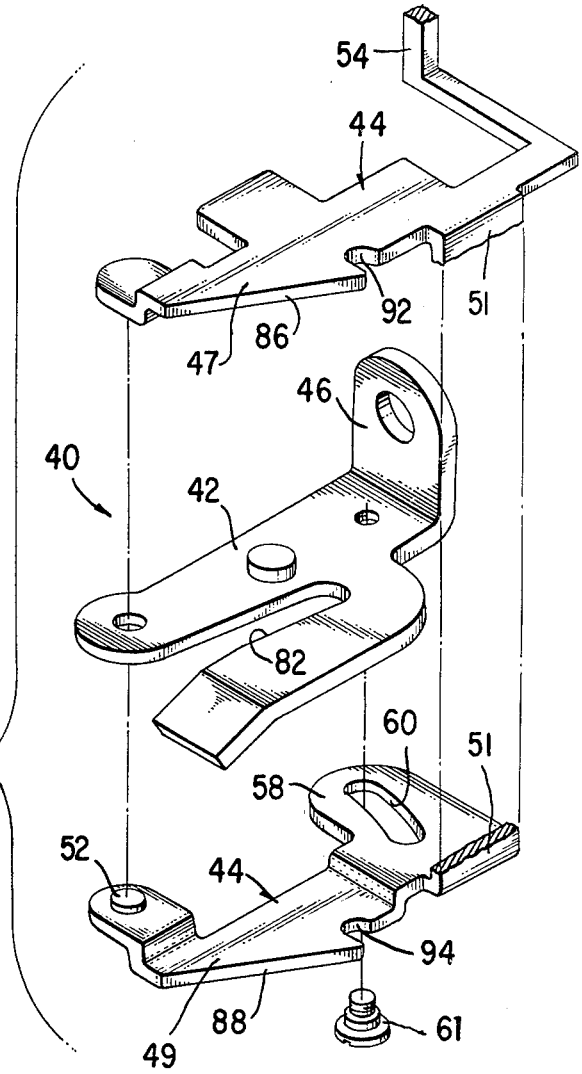
FIG. 4 is an exploded perspective view of the snubber.

Referring to FIGS. 1, 2, 3 and 4 of the drawings, reference character 10 designates a portion of a sewing machine according to the invention including a work supporting bed 12, a bracket arm 14 overhanging the bed and a depending head end portion 15. An endwise reciprocable needle bar 16 extending downwardly through head end portion 15 is operable by an arm shaft 18 acting through a counterweighted crank 20 and a link 24. As shown, link 24 is pivotally connected at its upper end by a stub shaft 23 with the crank 20 and at an intermediate location thereon by a stub shaft 25 with a needle bar fixed collar 26. As shown, the lower end of link 24 is formed with motion controlling cams 28 and 30 engageable with a follower cam 32 which is part of a slide 34 located between guiding surfaces 36 and 38. Slide 34 controls the operation of a needle thread snubbing device 40 located under head end portion 15 of the sewing machine in front of the needle bar 16.

Snubbing device 40 includes thread engageable parts 42 and 44. One part 42 includes an integral upstanding flange 46 which is affixed by a screw 48 to a head end frame portion 50 of the sewing machine. The other part 44 of the snubbing device including spaced apart portions 47 and 49 connected by a bridging portion 51 is pivotally connected to part 42 at 52 for movement about an axis substantially parallel to the needle bar 16. Part 44 includes a bracket extension 54 which extends into head end portion 15 to slide 34 where it is affixed by a screw 56 to the slide to enable movement of the part 44 by the slide. Slide 34 which includes the cam 32 is movable in a plane perpendicular to the axis of crank 20. As shown, portion 49 of part 44 includes a raised tab 58 which slidably engages the bottom of part 42. The tab includes an arcuate slot 60 wherein there is received the end of a screw 61 that is affixed in part 42.

Figure 5:
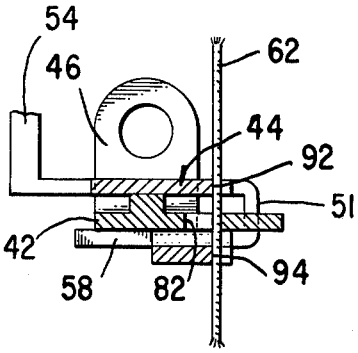
FIGS. 5 and 6 are fragmentary vertical sectional views taken on the plane of the line 5—5 of FIG. 3 showing the snubber in a thread releasing and thread snubbing condition respectively.
Figure 6:
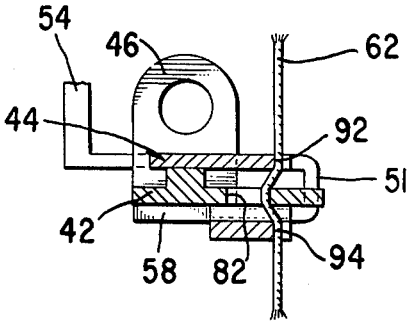

Needle thread 62 for sewing is arranged to extend over a thread guide 64, between tension discs 66 and 68 adjustable by a dial 70, under a thread guide 72, through a take-up lever 74, through snubber 40, through a thread guide 76 and through the eye 78 of a needle 80 affixed on the needle bar 16. Thread is introduced into the snubber 40 by way of slot 82 in part 42 and guided along diagonals 86 and 88 on part 44 until it registers in notches 92 and 94 in part 44. Snubber part 44 is movable between a thread releasing position as shown in FIG. 5 and an extreme thread snubbing position as shown in FIG. 6.

When crank 20 is at top dead center, (see FIG. 7) the needle bar 16 is in its highest position, cams 28 and 30 are out of contact with follower cam 32, slide 34 is caused to abut frame portion 50 at 94 by the action of a spring 96 having one end affixed to slide 34 and the opposite end affixed to frame portion 50 of the machine, and the movable part 44 of snubber 40 is in the thread releasing position permitting the free passage of needle thread through the snubber. Rotation of the crank 20 causes the needle bar to descend, and take-up lever 74 to move downwardly and slacken the thread. As shown, the take-up lever 74 is pivoted on the crank 20. A guiding lever 98 is pivotally connected at one end to the take-up lever 74 and at the opposite end to frame portion 50.

Cam 28 engages follower cam 32 (FIG. 8) as the needle bar 16 moves downwardly and causes slide 34 to be moved against the bias of spring 96 away from engagement with machine frame portion 50 (FIG. 9). Snubber part 44 is moved by the slide relative to snubber part 42 so as to cause thread 62 to be engaged by both such parts and a drag is imposed on the thread effective to limit the size of a loop presented by the needle for seizure by a loop taker. Cams 28 and 30 simultaneously disengage and engage respectively the follower cam 32 (FIG. 10) at a position of the slide 34 providing the maximum snubbing effect. As the crank 20 continues to rotate cam 30 maintains the slide 34 in a position effective to continue the snubbing action for a time and then permits the slide to be gradually returned by spring 96 to its position of engagement with frame portion 50 of the machine (FIG. 11) so eliminate the snubbing effect.

With loop seizure of the needle thread timed to occur, as for example about 160 degrees after the top dead center position of crank 20, the cams 28 and 30 are preferably adapted to initiate snubbing at about 135 degrees after top dead center and to release the needle thread at about 200 degrees after the top dead center position of the crank well before the needle thread is pulled tight by take-up lever 74 for stitch setting.

Figure 12:
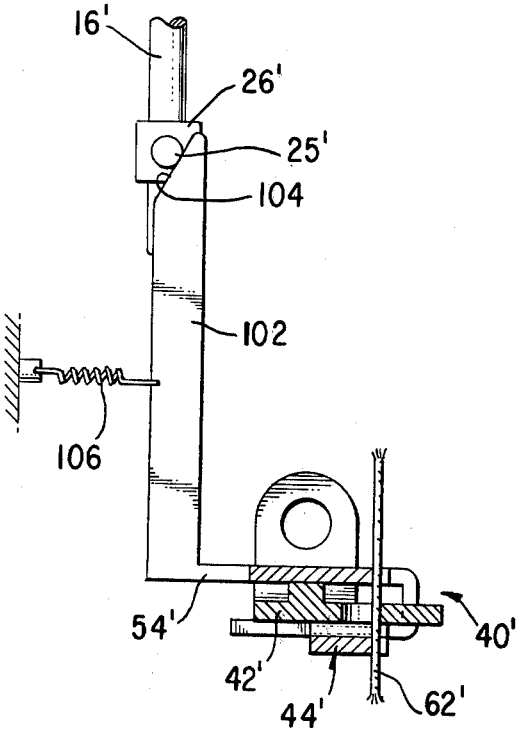
FIGS. 12 and 13 are somewhat diagrammatic views showing modified snubber actuating mechanism in different positions during operation of the machine.
Figure 13:
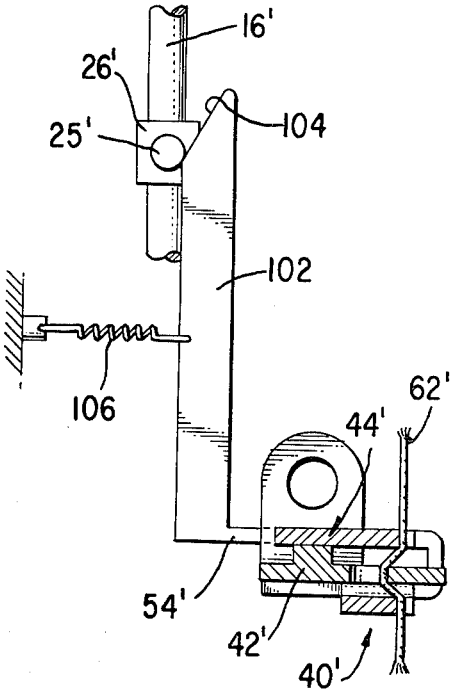

Referring to FIGS. 12 and 13 of the drawing, there is shown a modified construction according to the invention with parts thereof identified with reference characters corresponding to those previously used, but with the addition of prime mark (′), wherever the parts of the modified construction correspond to those of the construction of FIGS. 1 through 11. In the modified construction, movable part 44′ of a snubber 40′ includes a bracket extension 54′ which is integral with a link 102 that is provided at its opposite end with an inclined camming surface 104 engageable by a stub shaft 25′ on a collar 26′ affixed to a needle bar 16′. A spring 106 acting on link 102 biases part 44′ of the snubber toward a thread releasing position in which the end of a slot (corresponding to slot 60 in FIG. 4 in part) 44′ is engaged by a screw (corresponding to screw 61 in FIG. 4). Movement of link 102 against the bias of spring 106 is initiated (FIG. 12) by engagement of stub shaft 25′ with camming surface 104 at a point in the descent of the needle bar 16′, and as descent of the needle bar continues the snubber part 44′ is moved to snub needle thread extending between snubber parts 42′ and 44′. Maximum snubbing is realized when stub shaft 25′ reaches the lower end of camming surface 104 (FIG. 12). During upward movement of the needle bar 16′, stub shaft 25′ as it moves along camming surface 104 permits link 102 and movable snubber part 44′ to be moved by the action of spring 106 so as to eliminate the snubbing of needle thread. The camming surface 104 and linkages of the construction may be proportioned to cause snubbing to be initiated and maintained during the operating cycle of the machine as indicated, for example, for the form of the invention illustrated in FIGS. 1 through 11.

It is to be understood that the present disclosure relates to preferred embodiments of the invention which are for purposes of illustration only and are not to be construed as a limitation of the invention. Numerous alterations and modifications of the structure herein disclosed will suggest themselves to those skilled in the art, and all such modifications and alterations which do not depart from the spirit and scope of the invention are intended to be included within the scope of the appended claims.

I claim:

1. In a sewing machine including a bed, a bracket arm and a depending head end portion: a needle bar extending downwardly through said head end portion to a needle affixed thereon; a take-up; means for reciprocating the needle bar and take-up; a needle thread snubber between the take-up and needle, said snubber including thread engageable parts one of which is fixed on the depending head portion and another which is pivotally mounted for sliding movement on the said one part between a position for imposing a drag on thread between the parts and a position in which the drag is removed; a spring having one end fixed in said head end portion of the sewing machine and the other end operably connected to the pivotally mounted part of the snubber for biasing such pivotally mounted part into one of the said positions thereof; and means operably connected to the needle bar reciprocating means and extending through the depending head end portion of the machine for controlling movement of the pivotally mounted snubber part between the drag released and drag imposing positions in timed relation to reciprocation of the needle bar.

2. The combination of claim 1 wherein the snubber is located in front of the needle bar.

3. The combination of claim 1 wherein said another part of the snubber is pivotally mounted on the said one part and said one part is affixed on the head end portion of the machine.

4. The combination of claim 1 wherein the pivotal axis of said another part of the snubber is substantially parallel to the needle bar.

5. The combination of claim 1 wherein said another part of the snubber is biased by the spring into the drag released position.

6. The combination of claim 1 wherein the needle bar reciprocating means includes a rotatable member and a link which is pivotally connected at one end to the rotatable member, the link being pivotally connected between the ends of the needle bar; the said means for controlling movement of the pivotally mounted snubber part including camming at the end of said link opposite said one end, and a follower cam which is engageable by the camming on the link and connects with the pivotally mounted snubber part.

7. The combination of claim 6 wherein the follower cam is slidable in a plane perpendicular to the axis of the rotatable member.

8. The combination of claim 6 wherein the camming on the link includes an actuating cam and a holding cam.

9. The combination of claim 1 wherein the means for controlling movement of the pivotally mounted snubber part includes a link with a camming surface thereon, and a link actuating member engageable with the camming surface.

10. The combination of claim 9 wherein the link actuating member reciprocates in directions parallel to the needle bar.

11. The combination of claim 10 wherein the link actuating member is a stub shaft through which reciprocating motion is imparted to the needle bar.

* * * * *